US008069862B1

(12) United States Patent
Clark

(10) Patent No.: US 8,069,862 B1
(45) Date of Patent: Dec. 6, 2011

(54) HEAT-LESS HAIR STRAIGHTENING DEVICE

(76) Inventor: Nina Clark, Marietta, GA (US)

( * ) Notice: Subject to any disclaimer, the term of this patent is extended or adjusted under 35 U.S.C. 154(b) by 38 days.

(21) Appl. No.: 12/766,884

(22) Filed: Apr. 24, 2010

(51) Int. Cl.
*A45D 7/00* (2006.01)
*A45D 24/42* (2006.01)

(52) U.S. Cl. ..... 132/210; 132/119

(58) Field of Classification Search ..... 132/210, 132/119, 120, 130, 222, 223, 262, 270; 15/159.1, 15/160, 169, 176.1, 176.4, 176.6
See application file for complete search history.

(56) References Cited

U.S. PATENT DOCUMENTS 2,631,593 A * 3/1953 Madore ..... 132/222
2,818,869 A * 1/1958 Rose ..... 132/224
3,590,829 A * 7/1971 Parisi ..... 132/248
3,692,032 A 9/1972 Regas
3,871,388 A 3/1975 Leoci
5,519,912 A * 5/1996 Kawamura ..... 15/160
5,845,654 A 12/1998 Johnson
6,138,376 A * 10/2000 Garfinkel ..... 34/283
7,316,045 B2 * 1/2008 Koke ..... 15/169
2004/0045571 A1 3/2004 Kelsey

* cited by examiner

*Primary Examiner* — Robyn Doan
(74) *Attorney, Agent, or Firm* — George R. Reardon

(57) ABSTRACT

A hair straightening device and associated methods are disclosed. In one embodiment, a hair-straightening band includes: an elongated band; a bristle-tipped insert having a plurality of bristles, the bristle-tipped insert disposed within the elongated band; and a plate having a plurality of apertures through which to receive the plurality of bristles, the plate adapted to secure the insert to the elongated band with the plurality of bristles exposed. The hair band is adapted for application to a head of hair with the plurality of bristles facing inwardly toward the hair, rotation upon the hair, and wear upon the hair to straighten the hair. The hair band is heatless and non-electric.

20 Claims, 8 Drawing Sheets

HEAT-LESS HAIR STRAIGHTENING DEVICE

FIELD OF THE INVENTION

The technology described herein relates generally to devices, systems, and methods for straightening hair. More specifically, the technology described herein relates to a non-electric, heatless device for straightening hair.

BACKGROUND OF THE INVENTION

Persons having varying degrees of curly hair often desire to straighten their hair and remove any curls or waves. By way of example, women with kinky, curly, or wavy hair may desire to straighten their hair from time to time.

Hair straightening is a hair styling technique which involves the flattening and straightening of hair in order to give it a smooth, streamlined, and sleek appearance. Straightened hair may be accomplished by using devices such as hair irons and hot combs. Additionally, products such as chemical relaxers, and even some shampoos, conditioners, and hair gels, can help to make hair temporarily straight. Furthermore, methods such as, Japanese hair straightening or Brazilian hair straightening can be utilized to straighten hair. By way of example, one method of hair straightening is often called rebonding in Southeast Asia (e.g. Malaysia and Philippines).

These known devices, products, and methods have their respective deficiencies and shortcomings. For example, hair irons and hot combs can only temporarily modify hair texture. Although relaxers and the other methods seek to permanently alter the structure of the hair, new hair growth remains unaffected and, thus, is not straightened. The drug interferon alpha has been reported as being shown to modify hair follicles causing permanent change in a person's hair texture.

During much of the 20th century, social norms encouraged straightening of afro-textured hair which naturally has a tightly curled texture, resulting in artificial styles such as the conk. While the Black Power movement in the 1960s increased the acceptance of un-straightened, "natural" hairstyles such as the Afro, dreadlocks and braids, nevertheless, many African-American women still continue to straighten their hair as an aesthetic choice. Historically, hair straightening became more popular in the United States during the mid-late 1990s and through to the 2000s.

Related patents and published patent applications known in the background art include the following: U.S. Pat. No. 3,692,032, issued to Regas on Sep. 19, 1972, discloses a hair dressing appliance. U.S. Pat. No. 3,871,388, issued to Leoci on Mar. 18, 1975, discloses a hairdressing device. U.S. Pat. No. 5,845,654, issued to Johnson on Dec. 8, 1998, discloses a method and apparatus for styling hair. U.S. Published Patent Application No. 2004/0045571, filed by Kelsey and published on Mar. 11, 2004, discloses a method and device for straightening hair.

The foregoing patent information reflects the state of the art of which the inventor is aware and is tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

Thus, there remains an unmet need for an improved apparatus and associated method to straighten hair and address this unmet need.

BRIEF SUMMARY OF THE INVENTION

In various exemplary embodiments, the technology described herein provides a device and associated methods for straightening hair. The device and methods are non-electric and heatless. A hair straightening device is provided which facilitates the straightening of hair in an efficient and effective manner. Specifically, the hair straightening device pertains to a band of sufficient length to wrap around the head of a user. A degree of resilience is provided within the band to allow the band to be stretched to more tightly hold the hair of a user in place.

In one exemplary embodiment, the technology described herein provides a hair band. The hair band includes: an elongated band; a bristle-tipped insert having a plurality of bristles, the bristle-tipped insert disposed within the elongated band; and a plate having a plurality of apertures through which to receive the plurality of bristles, the plate adapted to secure the insert to the elongated band with the plurality of bristles exposed. The hair band is adapted for application to a head of hair with the plurality of bristles facing inwardly toward the hair, rotation upon the hair, and wear upon the hair to straighten the hair. The hair band is heatless and non-electric. The elongated band is adapted to curve inwardly, with the plurality of bristles facing inwardly. The elongated band comprises a tension. The elongated band can be nylon. The bristle-tipped insert can be a rubber material, a wood material, and a nylon material. The bristle-tipped insert is operatively interchangeable. The plurality of bristles can comprise a nylon material, boars bristles, ball-tipped bristles, and ball-tipped boars bristles. The plate comprises a cleaning plate adapted to remove hair and the like from the plurality of bristles as the plate is removed from the bristle-tipped insert. The plate can be a spring steel plate.

In another exemplary embodiment, the technology described herein provides a hair straightening device. The hair straightening device includes: a generally rectangular shell adapted to receive a plurality of interchangeable inserts and plates; a plurality of interchangeable bristle-tipped inserts, each having a plurality of bristles and adapted for insertion within the shell one at a time; and an interchangeable plate having a plurality of apertures through which to receive the plurality of bristles from one of the plurality of interchangeable bristle-tipped inserts, the plate adapted to secure the insert to the shell with the plurality of bristles exposed. The hair straightening device is adapted for application to a head of hair with the plurality of bristles facing inwardly toward the hair, rotation upon the hair, and wear upon the hair to straighten the hair. At least one of the interchangeable bristle-tipped inserts comprises a plurality of bristles comprising boars bristles. At least one of the interchangeable bristle-tipped inserts comprises a plurality of bristles comprising ball-tipped bristles. At least one of the interchangeable bristle-tipped inserts comprises ball-tipped boars bristles.

In yet another exemplary embodiment, the technology described herein provides a method for straightening hair. The method includes utilizing a hair band comprising: an elongated band; a bristle-tipped insert having a plurality of bristles, the bristle-tipped insert disposed within the elongated band; and a plate having a plurality of apertures through which to receive the plurality of bristles, the plate adapted to secure the insert to the elongated band with the plurality of bristles exposed; applying the hair band to a head; placing a pair of hands on opposing sides of the hair band; selectively rotating the hair band in a clockwise or counterclockwise motion, thereby pulling the hair in an upward motion; and wrapping the hair around the head until the hair disappears underneath the hair band. The method also can include interchanging the bristle tip insert with an alternative bristle tip.

The method further can include covering the hair band with a scarf, or like device, for a predetermined amount of time to straighten the hair.

Advantageously, the device and methods disclosed herein provide a hair straightening device that overcomes the fundamental challenges known with using electrical and heat devices that tend to damage hair.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the technology described herein. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a device and associated methods for straightening hair. The device and methods are non-electric and heatless.

Figure 1:
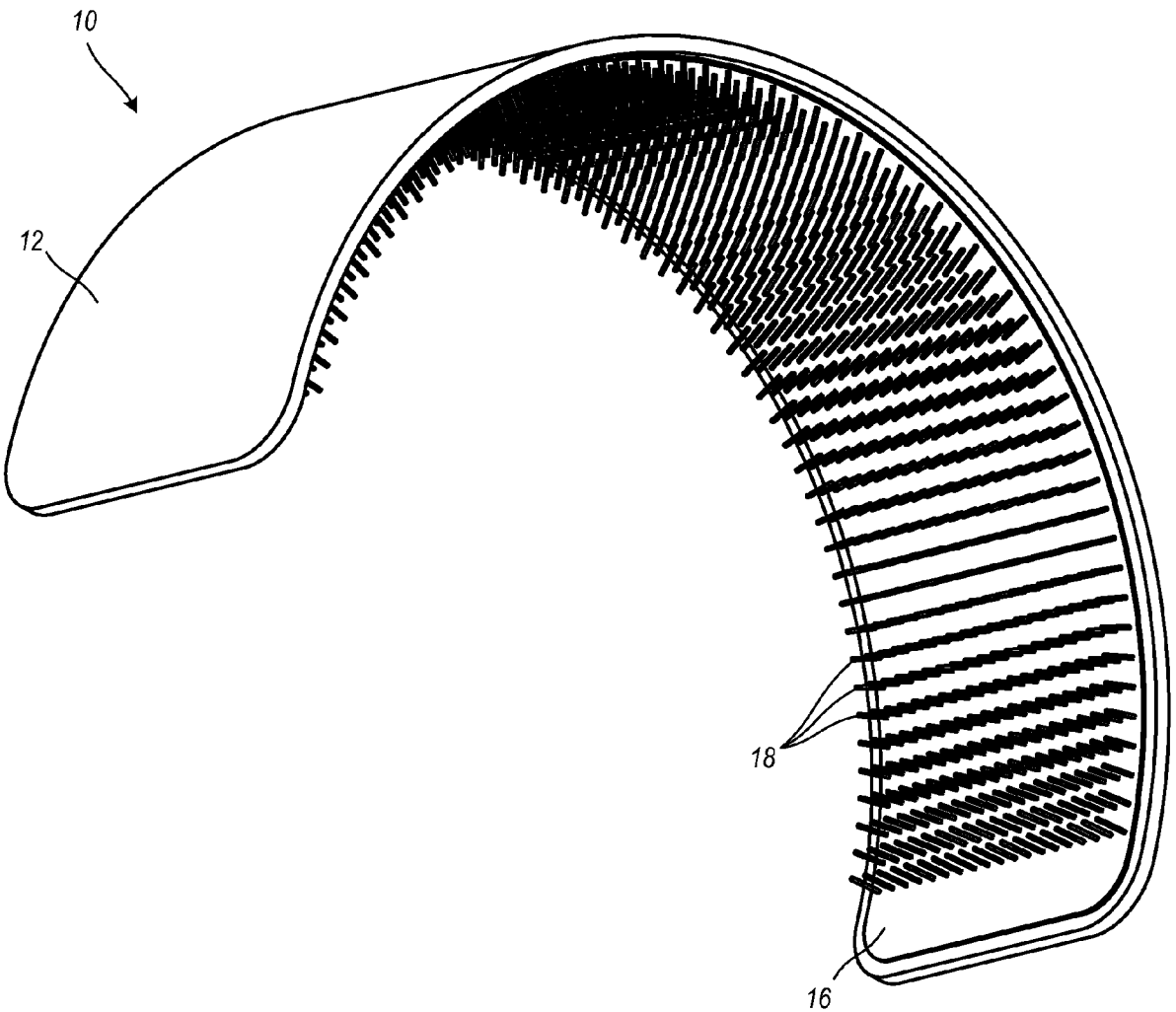
FIG. 1 is a front perspective view of a hair straightening device, according to an embodiment of the technology described herein.
Figure 2:
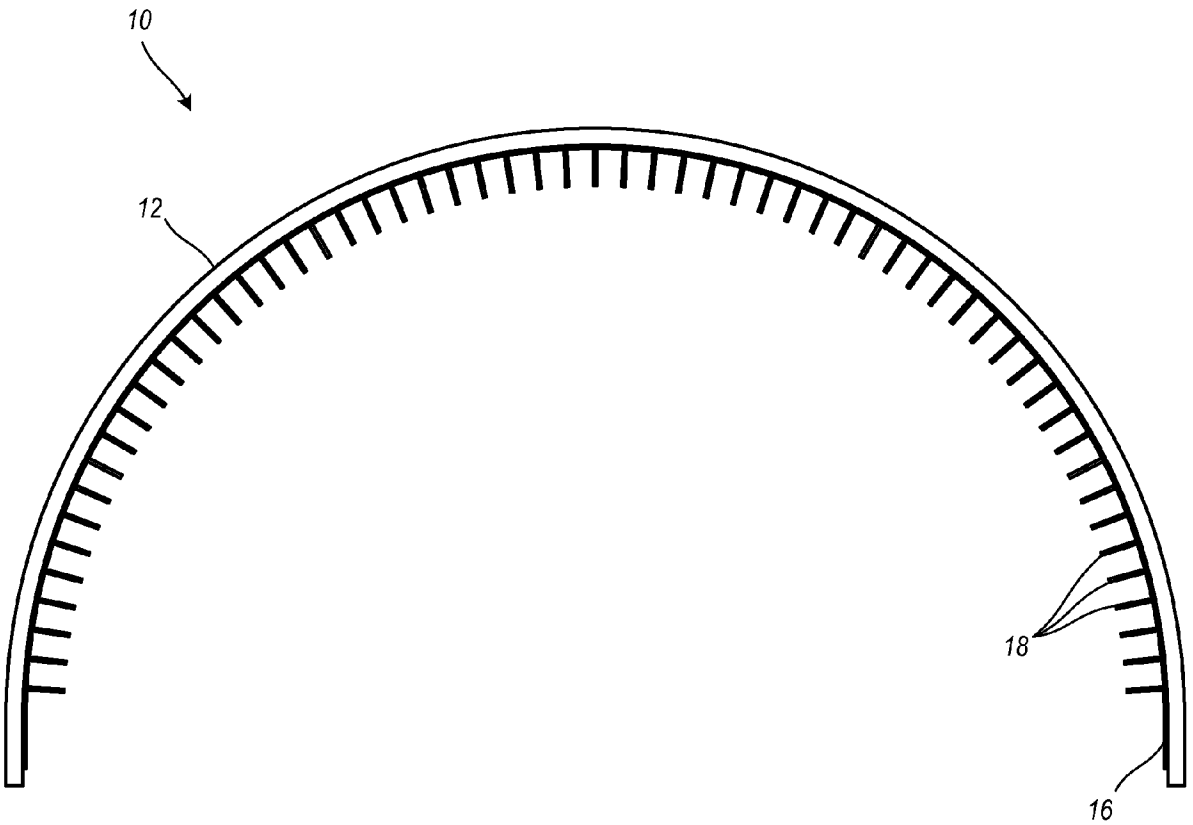
FIG. 2 is a front planar view of the hair straightening device depicted in FIG. 1.
Figure 3:
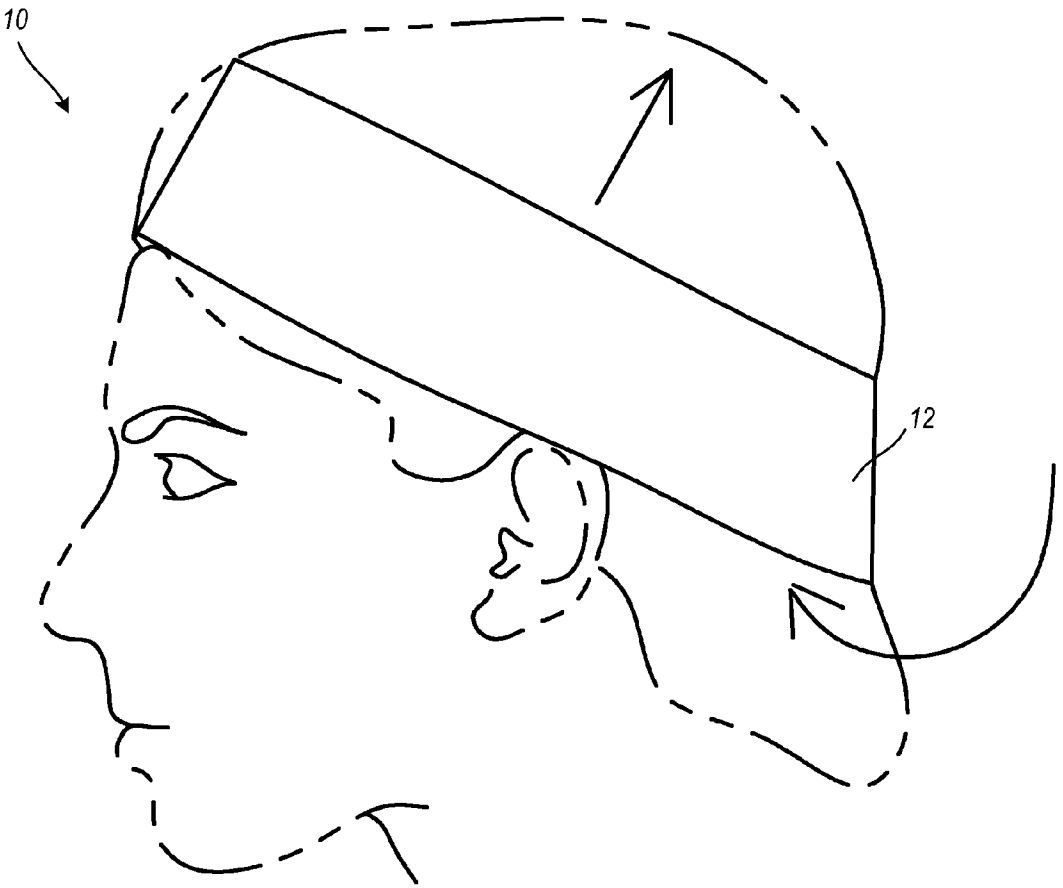
FIG. 3 is a schematic view of the hair straightening device depicted in FIG. 1, illustrating, in particular, how the device is applied, rotated, and worn to straighten hair, according to an embodiment of the technology described herein.
Figure 4:
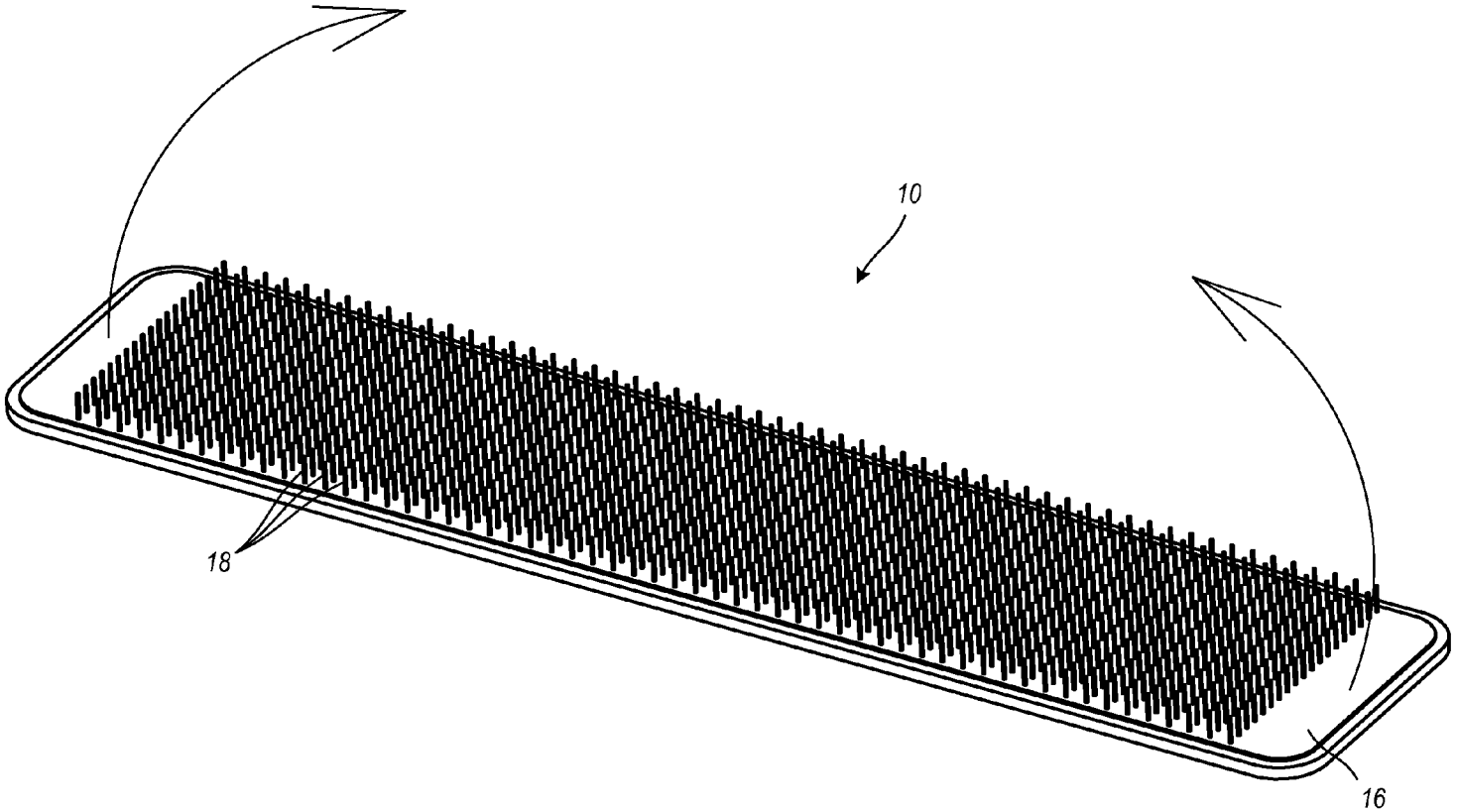
FIG. 4 is a front perspective view of the hair straightening device depicted in FIG. 1, illustrating, in particular, a direction of tension in the band, according to an embodiment of the technology described herein.
Figure 5:
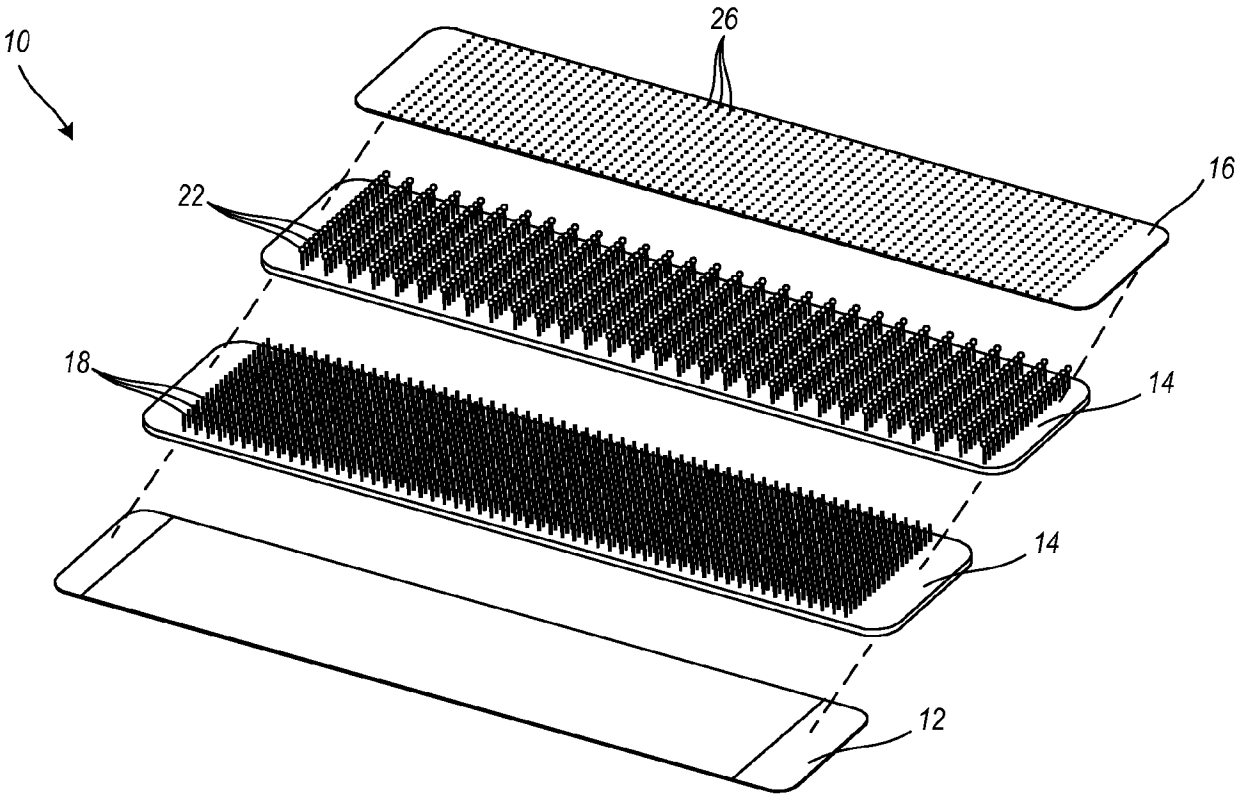
FIG. 5 is an expanded front perspective view of the hair straightening device depicted in FIG. 1, illustrating, in particular, the shell, insert, and bristles, according to an embodiment of the technology described herein.

Referring now to the Figures, in various exemplary embodiments, the technology described herein provides a hair straightening device 10. The hair straightening device 10 is in the form and shape of an elongated band, suitable for application and wear to the head of a user (as depicted in FIG. 3). The hair straightening device 10 is heatless and non-electric.

The hair straightening device 10 includes a shell 12 that is configured to receive inserts 14 having bristles 18. By way of example, and not of limitation, the shell 12 can be formed of a nylon material. The shell 12 is flexible to conform to the head of the user. Once applied, the shell 12 can be secured with an attachment means or can be wrapped with a scarf, wrap, or the like to securely hold the shell hair straightening device 10 in place upon the head of the wearer. In at least one embodiment, the shell 12 is formed with an inherent tension bowing the shell 12 facing inwardly. In at least one embodiment, the shell 12 is not predisposed with any tension.

The hair straightening device 10 includes a bristle-tipped insert 14 having a plurality of bristles 18. The bristles 18 can be arranged in rows or other patterns. The bristles 18 are shown generally straight and cylindrical, with no attachments or barbs. Alternative bristles configurations in various embodiments are disclosed below.

In various embodiments, the bristle-tipped insert 14 can be made of a rubber material, a wood material, and a nylon material. The bristle-tipped insert 14 is operatively interchangeable. This interchangeability provides for use of alternative bristle configurations as well as replacement of inserts 14 as needed or desired.

Figure 6:
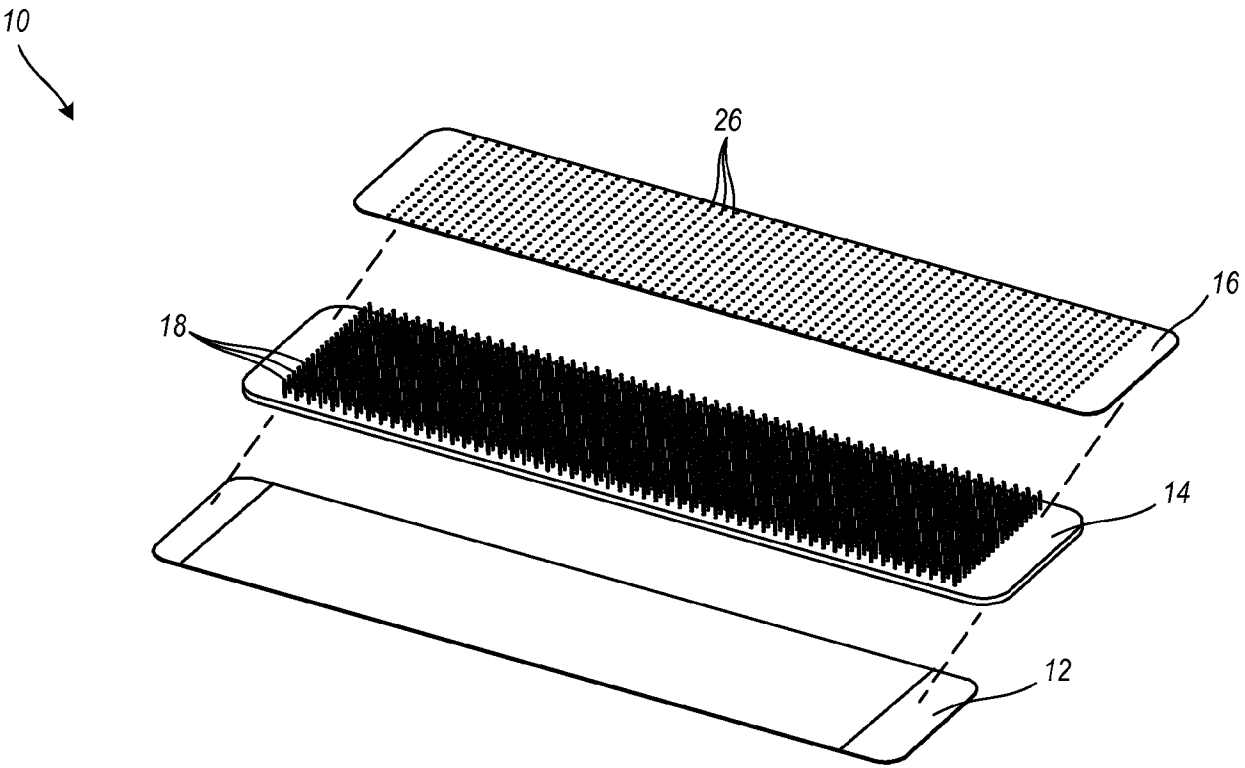
FIG. 6 is an expanded front perspective view of the hair straightening device depicted in FIG. 1, illustrating, in particular, the shell, insert, and bristles, according to an embodiment of the technology described herein.
Figure 7:
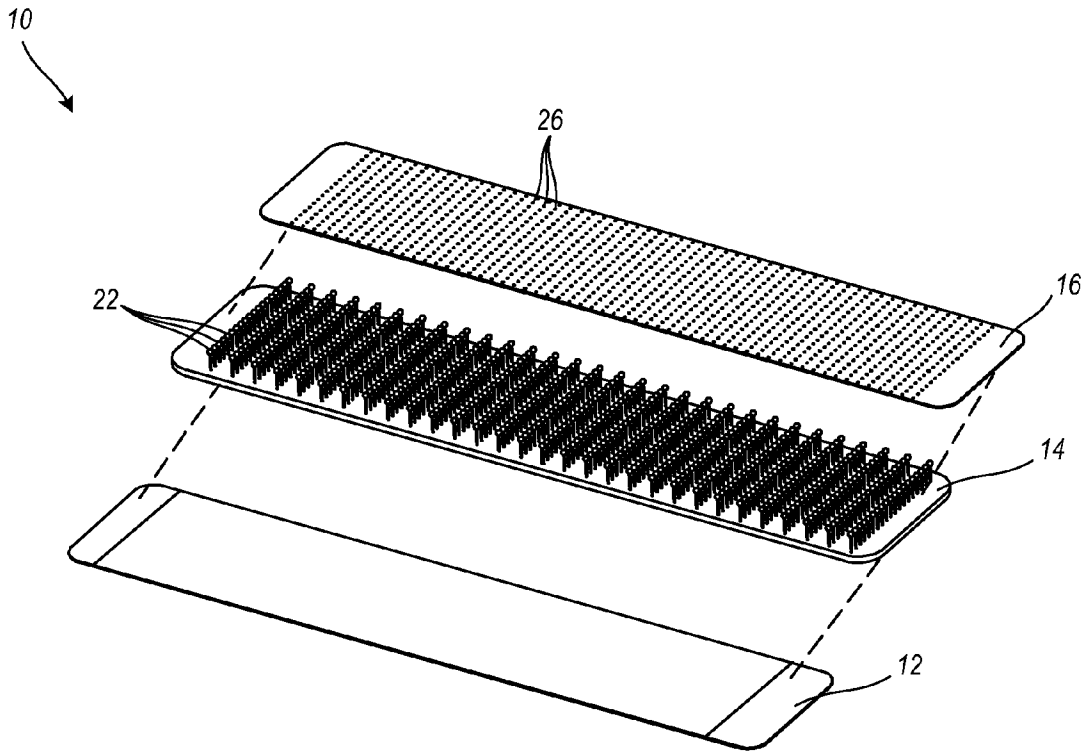
FIG. 7 is an expanded front perspective view of the hair straightening device depicted in FIG. 1, illustrating, in particular, the shell, insert, and ball-tipped bristles, according to an embodiment of the technology described herein.
Figure 8:
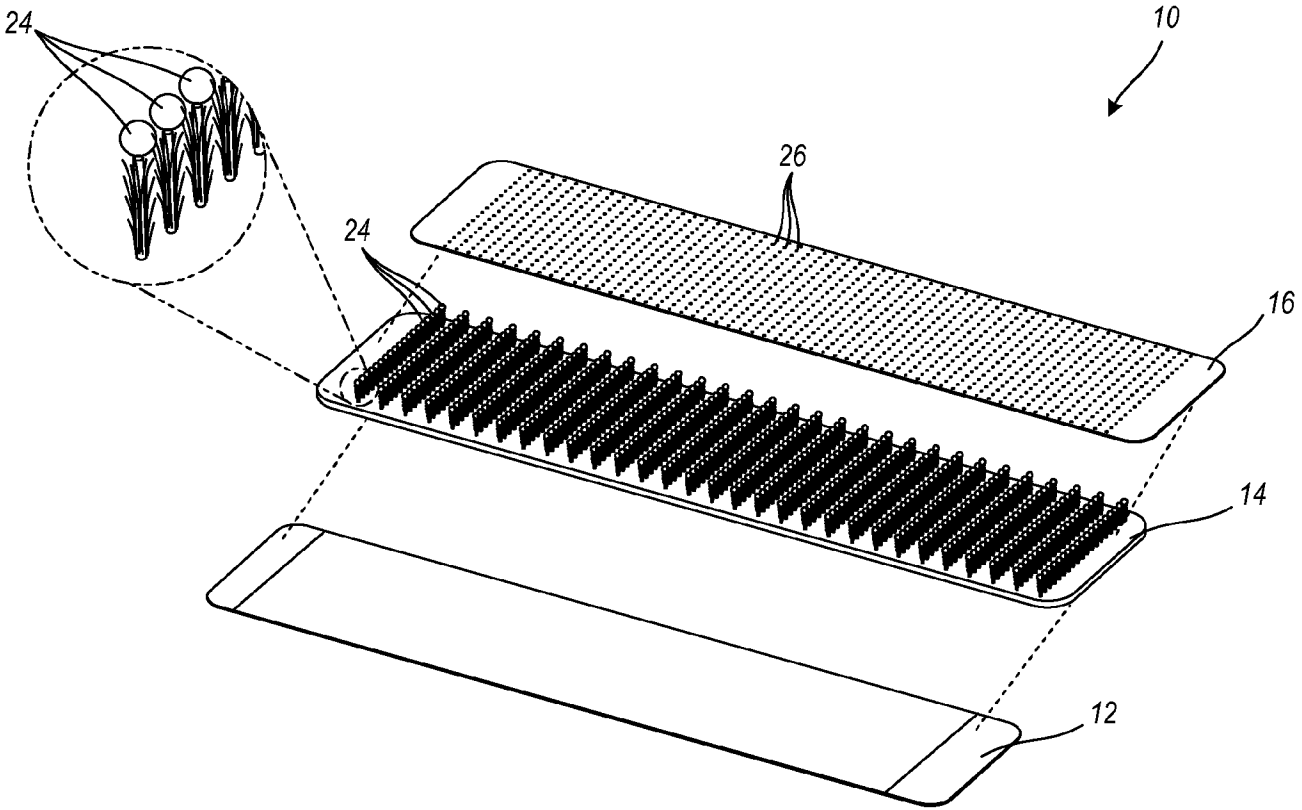
FIG. 8 is an expanded front perspective view of the hair straightening device depicted in FIG. 1, illustrating, in particular, the shell, insert, and ball-tipped boars bristles, according to an embodiment of the technology described herein.

The plurality of bristles 18 can be a nylon material. In various embodiments, the bristles can be boars bristles, ball-tipped bristles 22, and ball-tipped boars bristles 24. As depicted specifically in FIG. 6, the bristles 18 are shown generally straight and cylindrical, with no attachments or barbs. As depicted specifically in FIG. 7, the bristles 22 are shown in with a ball tip on each bristle. As depicted specifically in FIG. 8, the bristles 24 are shown with boars bristles each having a ball tip on each bristle. FIG. 8 provides a close-up view of a ball-tipped boars bristle wherein the various barbs are depicted.

By way of example, and not of limitation, the insert 14 with ball-tipped bristles 22 is utilized for wrapping hair that is wet. By way of example, and not of limitation, the insert 14 with ball-tipped boars bristles 24 is utilized for wrapping hair that is dry. Alternative configurations and inserts can be utilized dependent upon, for example, hair type, dryness or wetness of the hair, and desired degree of straightness sought.

The hair straightening device 10 includes a plate 16. The plate 16 includes a plurality of apertures 26 through which to receive the plurality of bristles 18. The plate 16 is adapted to secure the insert 14 to the shell 12 with the plurality of bristles 18, 22, or 24 exposed. The plate 16 can be a cleaning plate adapted to remove hair and the like from the plurality of bristles 18 as the plate 16 is removed from over the bristle-tipped insert 14. In at least one embodiment, the plate 16 is a spring steel plate.

The hair straightening device 10 is adapted for application to a head of hair with the plurality of bristles 18 facing inwardly toward the hair, rotation upon the hair, and wear upon the hair to straighten the hair. The hair straightening device 10 is adapted to curve inwardly, with the plurality of bristles 18 facing inwardly. The hair straightening device 10 comprises a tension in the shell 12.

In use, the hair straightening device can be utilized with the following methods steps: 1) utilizing a hair band 10 comprising: an elongated band (such as shell 12); a bristle-tipped insert 14 having a plurality of bristles 18, the bristle-tipped insert 14 disposed within the elongated band; and a plate 16 having a plurality of apertures 22 through which to receive the plurality of bristles 18, the plate 16 adapted to secure the insert 14 to the elongated band 12 with the plurality of bristles 18 exposed; 2) applying the hair band 10 to a head; 3) placing a pair of hands on opposing sides of the hair band 10; 4) selectively rotating the hair band 10 in a clockwise or counterclockwise motion, thereby pulling the hair in an upward motion; and 5) wrapping the hair around the head until the hair disappears underneath the hair band 10.

The method can also be utilized with the additional following methods steps: 1) interchanging the bristle tip insert 14 with an alternative bristle tip; and 2) covering the hair band 10 with a scarf, or like device, for a predetermined amount of time to straighten the hair.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the technology described herein and are intended to be covered by the following claims.

What is claimed is:

1. A hair band comprising:

an elongated flexible band;

a bristle-tipped insert having a plurality of bristles, the bristle-tipped insert disposed within the elongated band; and a plate having a plurality of apertures through which to receive the plurality of bristles, the plate holds the insert to the elongated band with the plurality of bristles exposed;

wherein the hair band is configured for application to a head of hair with the plurality of bristles facing inwardly toward the hair, rotation upon the hair, the hair band is configured to be wrapped around the head until the hair disappears underneath the hair band, and wear upon the hair to straighten the hair.

2. The hair band of claim 1, wherein the hair band is heatless and non-electric.

3. The hair band of claim 1, wherein the elongated band is adapted to curve inwardly, with the plurality of bristles facing inwardly, and wherein the elongated band comprise a tension.

4. The hair band of claim 1, wherein the elongated band comprises a nylon material.

5. The hair band of claim 1, wherein the bristle-tipped insert comprises a rubber material.

6. The hair band of claim 1, wherein the bristle-tipped insert comprises a wood material.

7. The hair band of claim 1, wherein the bristle-tipped insert is operatively interchangeable.

8. The hair band of claim 1, wherein the plurality of bristles comprises a nylon material.

9. The hair band of claim 1, wherein the plurality of bristles comprises boars bristles.

10. The hair band of claim 1, wherein the plurality of bristles comprises ball-tipped bristles.

11. The hair band of claim 1, wherein the plurality of bristles comprises ball-tipped boars bristles.

12. The hair band of claim 1, wherein the plate comprises a cleaning plate adapted to remove hair and the like from the plurality of bristles as the plate is removed from the bristle-tipped insert.

13. The hair band of claim 1, wherein the plate comprises a spring steel plate.

14. A hair straightening device comprising:

a generally rectangular flexible shell configured to receive a plurality of interchangeable inserts and plates;

a plurality of interchangeable bristle-tipped inserts, each having a plurality of bristles and disposed within the shell one at a time; and an interchangeable plate having a plurality of apertures through which to receive the plurality of bristles from one of the plurality of interchangeable bristle-tipped inserts, the plate holds the insert to the shell with the plurality of bristles exposed;

wherein the hair straightening device is configured for application to a head of hair with the plurality of bristles facing inwardly toward the hair, rotation upon the hair, the hair band is configured to be wrapped around the head until the hair disappears underneath the hair band, and wear upon the hair to straighten the hair.

15. The hair straightening device of claim 14, wherein at least one of the interchangeable bristle-tipped inserts comprises a plurality of bristles comprising boars bristles.

16. The hair straightening device of claim 14, wherein at least one of the interchangeable bristle-tipped inserts comprises a plurality of bristles comprising ball-tipped bristles.

17. The hair straightening device of claim 14, wherein at least one of the interchangeable bristle-tipped inserts comprises ball-tipped boars bristles.

18. A method for straightening hair, the method comprising:

utilizing a hair band comprising: an elongated band; a bristle-tipped insert having a plurality of bristles, the bristle-tipped insert disposed within the elongated band; and a plate having a plurality of apertures through which to receive the plurality of bristles, the plate adapted to secure the insert to the elongated band with the plurality of bristles exposed;

applying the hair band to a head;

placing a pair of hands on opposing sides of the hair band;

selectively rotating the hair band in a clockwise or counterclockwise motion, thereby pulling the hair in an upward motion; and wrapping the hair band around the head until the hair disappears underneath the hair band.

19. The method of claim 18, further comprising:

interchanging the bristle tip insert with an alternative bristle tip.

20. The method of claim 18, further comprising:

covering the hair band with a scarf, or like device, for a predetermined amount of time to straighten the hair.

* * * * *